US006296365B1

(12) United States Patent
McCalla et al.

(10) Patent No.: US 6,296,365 B1
(45) Date of Patent: Oct. 2, 2001

(54) LIGHTED HAND TOOL

(75) Inventors: Gavin McCalla; William R. Lutz; Steve R. Burns, all of Cumming, GA (US)

(73) Assignee: McCalla Company, Alpharetta, GA (US)

( * ) Notice: Subject to any disclaimer, the term of this patent is extended or adjusted under 35 U.S.C. 154(b) by 0 days.

(21) Appl. No.: 09/497,736

(22) Filed: Feb. 4, 2000

(51) Int. Cl.[7] ..... B25B 23/18
(52) U.S. Cl. ..... 362/119; 362/577
(58) Field of Search ..... 362/577, 109, 362/119, 120

(56) References Cited

U.S. PATENT DOCUMENTS

| | | | |
|---|---|---|---|
| 65,162 | 5/1867 | Brown . | |
| D. 182,397 | 4/1958 | Blum . | |
| D. 197,757 | 3/1964 | Nagamori | D93/4 |
| 198,264 | 12/1877 | Barlow . | |
| D. 323,449 | 1/1992 | Corona et al. | D8/83 |
| D. 327,827 | 7/1992 | Kwan | D8/61 |
| D. 328,699 | 8/1992 | Shaanan et al. | D8/82 |
| D. 330,497 | 10/1992 | Hsin | D8/68 |
| D. 331,356 | 12/1992 | Amsberry | D8/68 |
| D. 340,633 | 10/1993 | Badiali | D8/85 |
| D. 358,316 | 5/1995 | Markwart et al. | D8/82 |
| D. 363,012 | 10/1995 | Humphries | D8/87 |
| D. 367,807 | 3/1996 | Hung | D8/52 |
| D. 376,305 | 12/1996 | Kung | D8/82 |
| D. 383,660 | 9/1997 | Anderson | D8/83 |
| D. 412,096 | 7/1999 | Kung et al. | D8/87 |
| D. 415,939 | 11/1999 | Staton | D8/52 |
| D. 418,031 | 12/1999 | Khachatoorian | D8/58 |
| D. 419,841 | 2/2000 | Wrigley | D8/52 |
| 482,198 | 9/1892 | Ryan . | |
| 597,101 | 1/1898 | Collings . | |
| 908,947 | 1/1909 | Burkhart . | |
| 957,560 | 5/1910 | Holt . | |
| 1,144,210 | 6/1915 | Kincaid . | |
| 1,236,138 | 8/1917 | Bernard . | |
| 1,439,404 | 12/1922 | Cotharin | 240/6.46 |
| 1,603,985 | 10/1926 | Rosenberg . | |
| 1,635,933 | 7/1927 | Genoves . | |
| 1,657,348 | 1/1928 | Drumm . | |
| 1,715,426 | 6/1929 | Peterson . | |
| 1,763,527 | 6/1930 | Jones . | |
| 1,895,314 | 1/1933 | Dripps . | |

(List continued on next page.)

FOREIGN PATENT DOCUMENTS

| | | |
|---|---|---|
| 0 306 461 A1 | 3/1989 | (EP) . |
| 0 421 721 A2 | 10/1991 | (EP) . |
| 2 031 316 B | 11/1982 | (GB) . |
| 2 053 438 B | 4/1983 | (GB) . |
| 2 272 967 | 6/1996 | (GB) . |

*Primary Examiner*—Stephen Husar
(74) *Attorney, Agent, or Firm*—Needle & Rosenberg, P.C.

(57) ABSTRACT

A lighted hand tool, such as a lighted plier tool, including first and second plier members and a light source. Each plier member having a handle portion, a jaw portion, and a pivot section being intermediate the handle portion and the jaw portion for each plier member. The second plier member pivotally mounted relative to the pivot section of the first plier member at the pivot section of the second plier member for being pivotable relative to the first plier member. The handle portion of the first plier member defining a bore longitudinally extending along at least a portion of the length of the handle portion, the bore having a bore front end near the first pivot section. The light source is disposed within the bore of the handle portion adjacent the bore front end and is capable of producing a beam of light. Thus, the light source is energized from a power means, the beam of light produced by the light source is in communication with at least one portion of the first and second plier members.

46 Claims, 4 Drawing Sheets

U.S. PATENT DOCUMENTS

| | | | | |
|---|---|---|---|---|
| 2,242,536 | | 5/1941 | Montgomery | 240/6.46 |
| 2,288,093 | | 6/1942 | Kaffenberger et al. | 240/6.46 |
| 2,341,375 | | 2/1944 | Hambleton | 240/6.46 |
| 2,392,118 | | 1/1946 | Cacarillo | 30/261 |
| 2,466,342 | | 1/1949 | Watts | 240/6.46 |
| 2,706,769 | | 4/1955 | Cook | 240/6.46 |
| 2,736,792 | | 2/1956 | Freeland | 240/6.46 |
| 2,773,974 | | 12/1956 | Markett | 240/6.46 |
| 2,783,364 | | 2/1957 | Wood, Jr. | 240/6.46 |
| 3,176,551 | | 4/1965 | Hansen | 81/423 |
| 3,185,832 | | 5/1965 | Nagamori | 240/6.46 |
| 3,575,070 | | 4/1971 | Nichols | 81/416 |
| 3,603,782 | | 9/1971 | Wortmann | 240/6.46 |
| 3,919,541 | | 11/1975 | Chao | 240/6.46 |
| 4,283,757 | | 8/1981 | Nalbandian et al. | 362/120 |
| 4,296,655 | | 10/1981 | Tesoro | 81/405 |
| 4,458,300 | * | 7/1984 | Walsh | 362/206 |
| 4,669,340 | | 6/1987 | Igarashi | 81/416 |
| 4,719,827 | | 1/1988 | Igarashi | 81/417 |
| 4,768,137 | | 8/1988 | Hwaw et al. | 362/120 |
| 4,903,558 | | 2/1990 | le Duc | 81/416 |
| 4,936,171 | | 6/1990 | Berg | 81/451 |
| 5,124,893 | | 6/1992 | Jeng | 362/120 |
| 5,211,468 | | 5/1993 | Jeng | 362/120 |
| 5,265,504 | | 11/1993 | Fruhm | 81/439 |
| 5,369,555 | | 11/1994 | McKain et al. | 362/120 |
| 5,473,519 | | 12/1995 | McCallops et al. | 362/120 |
| 5,510,962 | | 4/1996 | Hsiao | 362/120 |
| 5,515,249 | | 5/1996 | Shiao | 362/119 |
| 5,550,719 | | 8/1996 | Kuo | 362/120 |
| 5,568,698 | * | 10/1996 | Harding et al. | 362/119 X |
| 5,577,829 | | 11/1996 | Hall | 362/119 |
| 5,584,565 | | 12/1996 | Berg | 362/120 |
| 5,628,115 | | 5/1997 | Hebert | 30/262 |
| 5,628,556 | | 5/1997 | Hrabar et al. | 362/119 |
| 5,713,656 | | 2/1998 | Lin | 362/120 |
| 5,904,078 | | 5/1999 | Gustafson et al. | 81/417 |
| 5,921,654 | * | 7/1999 | Coyle | 362/120 |

* cited by examiner

LIGHTED HAND TOOL

BACKGROUND OF THE INVENTION

1. Field of the Invention

The present invention relates to a lighted hand tool that can be used to illuminate a tool or work piece grasped thereby, and more particularly to a lighted plier hand tool, in which the lighted plier hand tool includes a plier member having a handle portion and a light source received within a portion of the handle portion.

2. Background Art

Developments in the art have produced various solutions to the problem of technicians working on equipment and components positioned in poorly-lit environments. For example, automobile and industrial components are often located inside of unlighted enclosures or in areas that block external background light. This problem is particularly troublesome for industrial equipment that is located next to other components that can easily be damaged or that present a hazard to the technician, such as exposed high-voltage sources.

One prior art solution to this problem is a trouble light, which is a light that is connected to an outlet by an extension cord and that the technician hangs in a position to illuminate the component. One obvious problem with this solution is the requirement that an electrical outlet or other power source be located near the equipment that is to be serviced. Additionally, a trouble light and its extension cord are bulky so technicians do not normally carry them when inspecting and adjusting equipment.

Another solution in the art is the development of tools that generate their own light, instead of using external lighting. The advantage of this approach is that the beam of light generated by the tool is directed at the area where the technician is performing the work. Thus, the lighted tools can be used to manipulate nuts, bolts, screws and other fasteners in the poorly-lighted environments using light produced by the tool itself. One example of this solution is disclosed in U.S. Pat. No. 2,242,536, which issued to Montgomery in 1941. More recent examples of similar tools are disclosed in U.S. Pat. Nos. 4,324,158 to Le Roy, 5,577,829 to Hall, and 5,628,556 to Hrabar et al. The lighted tools have been found to be more advantageous than other prior art techniques.

However, many technicians still carry small flashlights in addition to the lighted tools. One reason is that the light generated by the tool is diffused passing though the tool more than passing through the lens of a flashlight and, therefore, the light from the tool is a lower intensity than from the flashlight. Accordingly, a need exists in the art for a hand tool, such as a lighted plier hand tool, that has a light source which provides illumination to the desired work surface or object to be grasped by the plier hand tool that closely approximates the illumination that would be delivered by a separate small flashlight.

SUMMARY OF THE INVENTION

The present invention satisfies this and other needs in the art and comprises a lighted hand tool, such as a lighted plier tool, having a first plier member, a second plier member, and a light source for illuminating a portion of first and/or second plier member. Each plier member has a handle portion, a pivot section, and a jaw portion. The first and second plier members are pivotally connected relative to each other at the respective pivot sections of the plier members. This pivotal connection allows the plier members to be moveable between a closed position, in which a portion of the jaw portions of the first and second plier members contact each other, and an opened position, in which the jaw portions of the first and second plier members are spaced apart.

The handle portion of the first plier member has a distal end, a proximal end, and a length extending between the proximal and distal ends. The handle portion further defines a bore extending longitudinally along at least a portion of the length of the first plier member and having a bore front end near the pivot section of the first plier member and an opposite bore back end adjacent the proximal end of the first plier member.

The light source is capable of producing a beam of light and is disposed within the bore adjacent the bore front end. When the light source is energized, the light beam emitted therefrom illuminates at least a portion of the first or second plier members, preferably a portion of the jaw portions of the first and second plier members, and more preferably, a portion of the jaw portions of the first and second plier members adjacent a portion of a work piece proximate to, or grasped by, the jaw portions of the first and second plier members.

The lighted plier may also have a light guide assembly having a guide head and at least one elongated optically conductive tube. The guide head is of a size to be complementarily received within the bore of the handle portion of the first plier member proximate the bore front end and intermediate the bore front end and the light source. Each conductive tube has a first light end and an opposed second light end which forms a light aperture. The first light end is connected to the guide head and is in communication with the light source. Thus, when the light source is energized, the light beam emitted therefrom communicates with the first light end and travels from the first light end to the second light end of each optically conductive tube to exit out of the light aperture. The second end of each conductive tube is secured to the lighted plier hand tool so that the light exiting out of each light aperture illuminates at least a portion of the first and second plier members, preferably a portion of the jaw portions of the first and second plier members, and more preferably, a portion of the jaw portions of the first and second plier members adjacent a portion of a work piece proximate to, or grasped by, the jaw portions of the first and second plier members.

The present invention additionally includes a method for illuminating a portion or a first end of a work piece that is proximate to or grasped between the jaw portion of the first plier member of a lighted plier. The method comprises the step of energizing the light source to produce a beam of light that is in communication with at least one portion of the jaw portion of the first plier member and/or a portion of the work piece.

These and other features of the present invention will become more fully apparent from the following description and accompanying drawings.

DETAILED DESCRIPTION OF THE INVENTION

Figure 1:
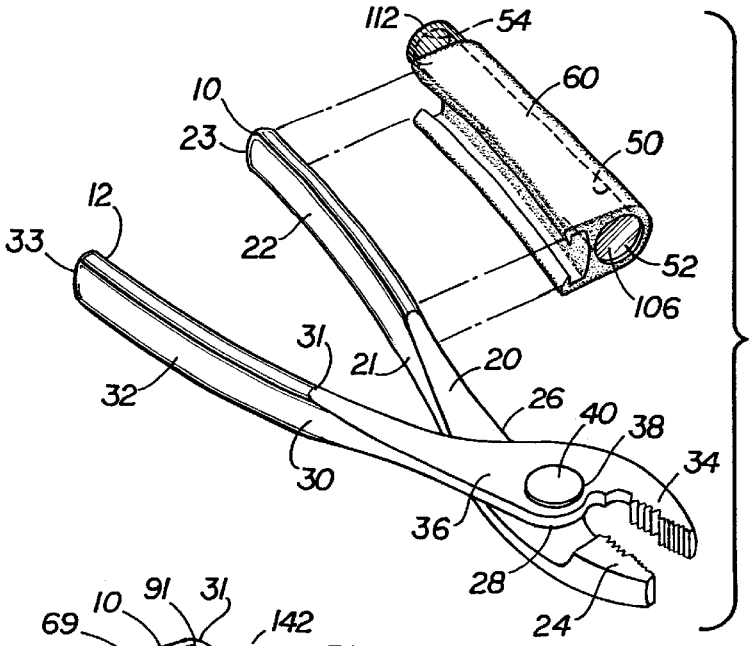
FIG. 1 is a partially exploded perspective view of a first embodiment of a lighted plier tool of the present invention.

The present invention is more particularly described in the following examples that are intended as illustrative only since numerous modifications and variations therein will be apparent to those skilled in the art. As used in the specification and in the claims, "a," "an," or "the" can mean one or more, depending upon the context in which it is used. The preferred embodiment is now described with reference to the figures, in which like numbers indicate like parts throughout the figures.

Referring generally to FIGS. 1–7, the present invention encompasses a lighted hand tool 10 of the crossed, pivoting lever type, particularly in the nature of a lighted plier tool 12, and more particularly, in the nature of a lighted slip-joint plier tool. The lighted pliers 12 includes a first plier member 20, a second plier member 30 and a means for illuminating a portion of the first and/or second plier member 20, 30.

Each plier member 20, 30 has a handle portion 22, 32, a jaw portion 24, 34, and pivot section 26, 36. The crossed first and second plier members 20, 30 are pivotally connected to each other in a scissor-like assembly, in which the pivot section 36 of the second plier member 30 is mounted relative to the pivot section 26 of the first plier member 20 so that the second plier member 30 is pivotable relative to the first plier member 20.

Figure 2:
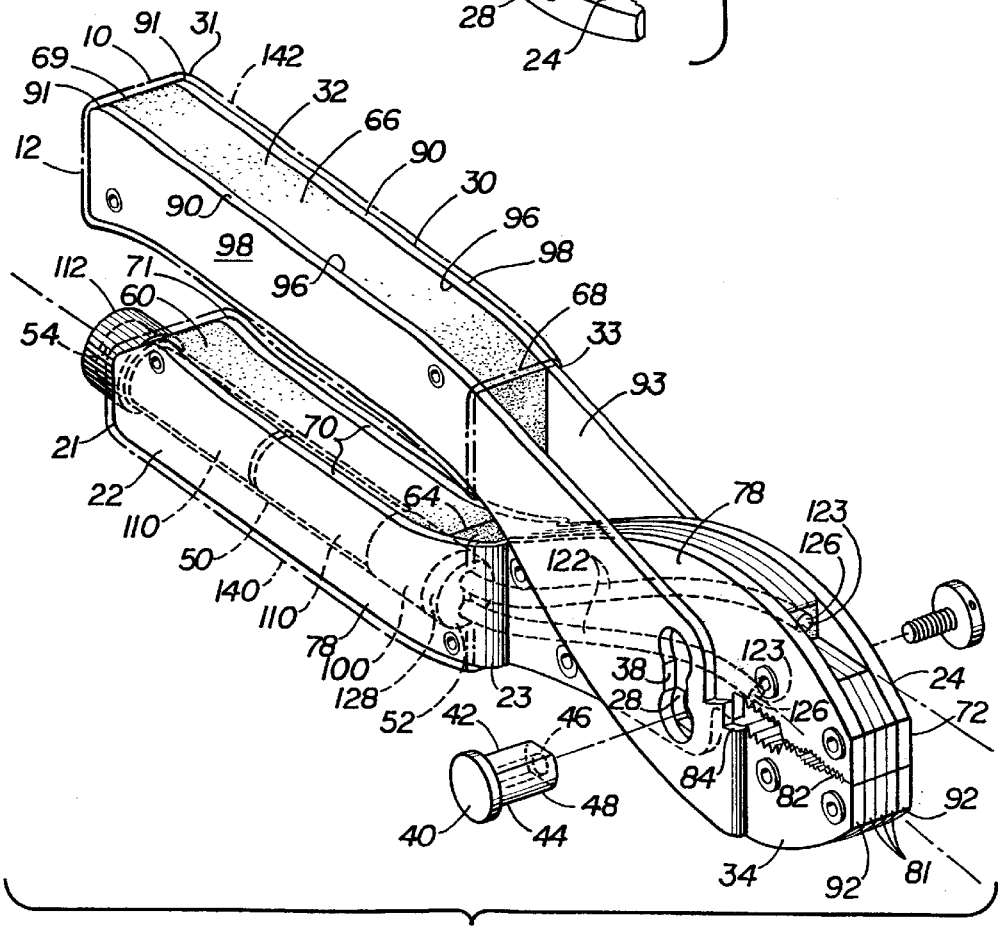
FIG. 2 is a partially exploded perspective view of a second embodiment of a lighted plier tool of the present invention.
Figure 5:
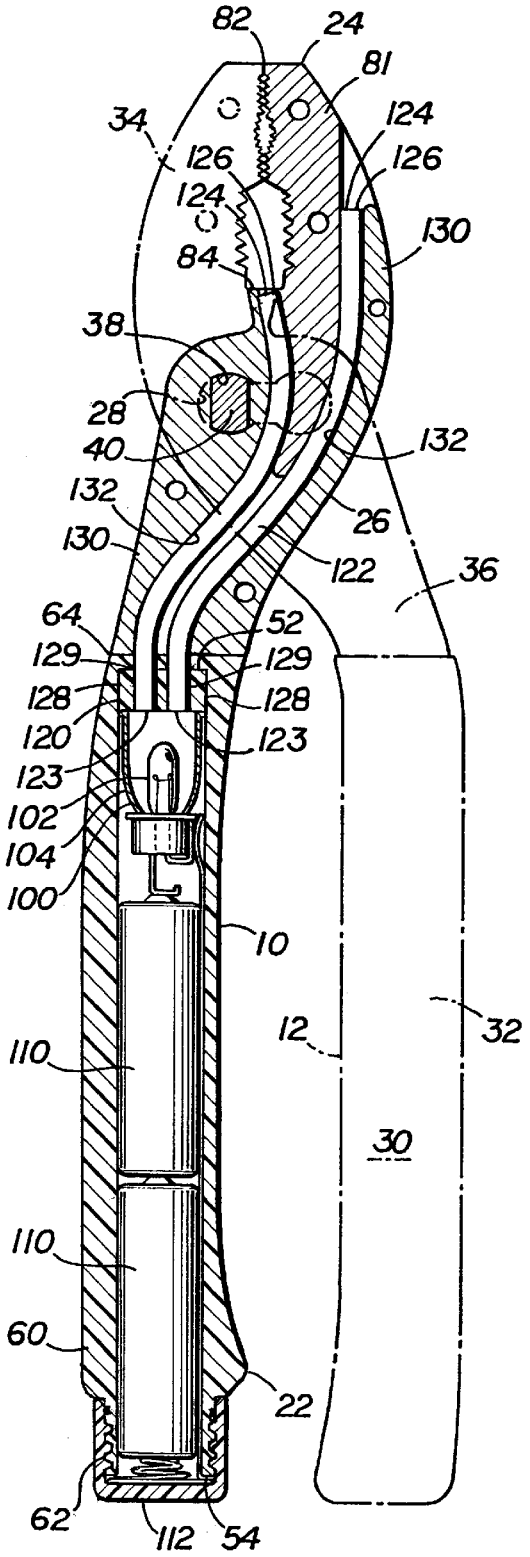
FIG. 5 is a partial cross-sectional side view of the first plier member taken along section line 5—5 of FIG. 4.
Figure 4:
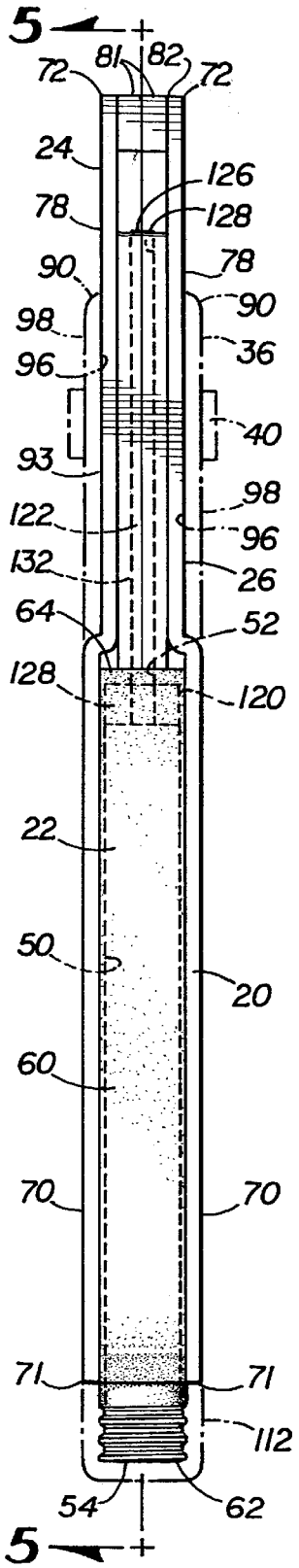
FIG. 4 is a top plan view of the first plier member of the lighted plier tool shown in FIG. 2.
Figure 7:
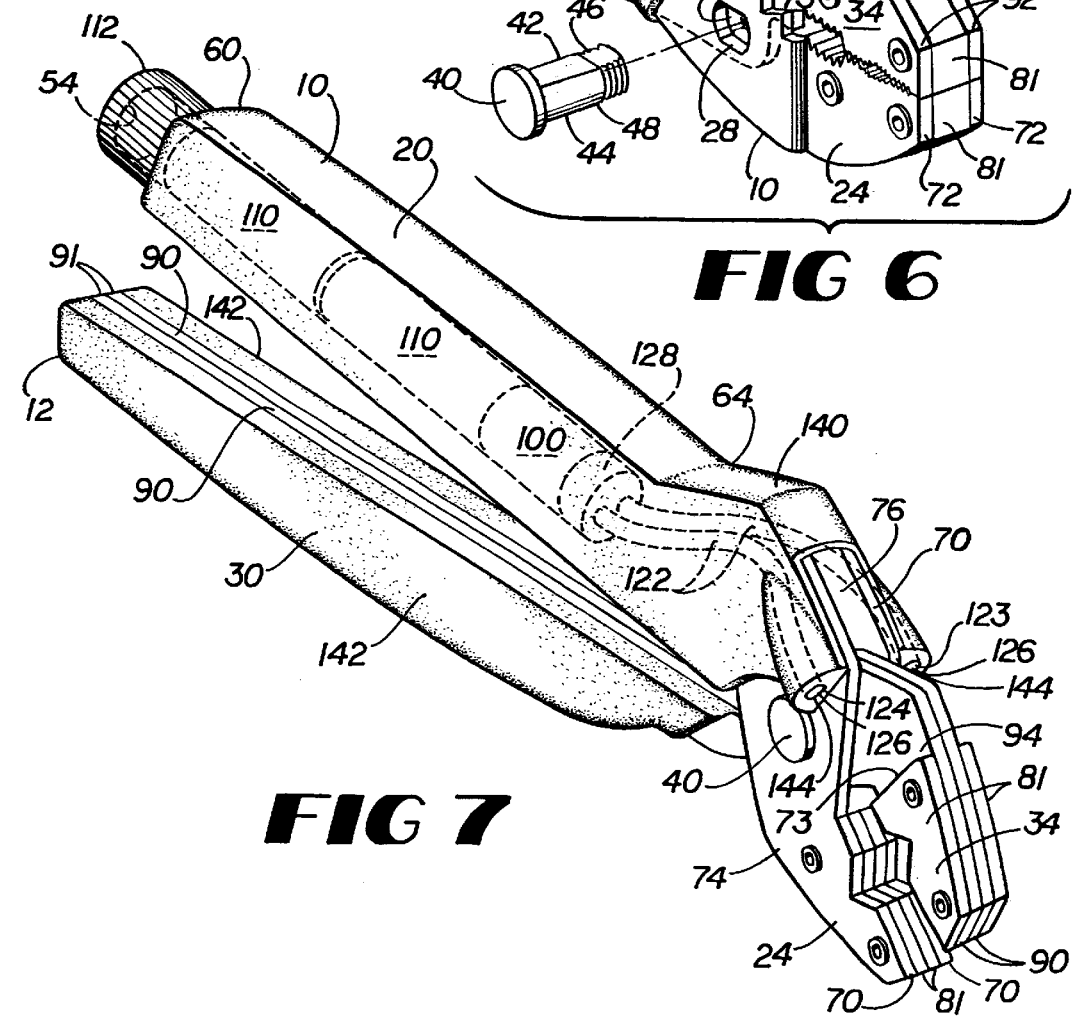
FIG. 7 is a perspective view of a fourth embodiment of a lighted tool of the present invention showing internal components in phantom.

Thus, in operation, the lighted pliers 12 are moved to a closed position, in which a portion of the jaw portions 24, 34 of the first and second plier members 20, 30 contact each other, by moving the handle portions 22, 32 of the first and second plier members 20, 30 together in a known manner. However, as one skilled in the art will appreciate, if a slip-joint is used in the lighted pliers 12 and the light pliers 12 are adjusted in a known manner to expand to the maximum open position, when the lighted pliers 12 are moved to the closed position by moving the handle members 22, 32 together, the jaw portions 26, 36 of the first and second plier members 20, 30 will be spaced apart a predetermined distance in the closed position (i.e., the minimum separation distance). The pliers 12 may be moved to an open position, in which the jaw portions 26, 36 of the first and second plier members 20, 30 are spaced apart, by moving the handle portions 22, 32 of the first and second plier members 20, 30 away from each other. FIG. 1 shows the lighted pliers 12 in the open position and FIGS. 2, 5 and 7 shown the lighted pliers in the closed position.

Formed through the pivot section 26 of the first plier member 20 is a first opening 28. Similarly, the pivot section 36 of the second plier member 30 has a second opening 38 formed therethrough. The lighted pliers 12 are pivotally connected by a pivot shaft 40 extending through the first and second openings 28, 38 of the crossed first and second plier members 20, 30. For example, the pivot shaft 40 may include a bolt which is threadedly engaged with a nut for holding the first and second plier members 20, 30 together, or may include a rivet for holding the first and second plier members 20, 30 together. As one skilled in the art will appreciate, other types of pivot arrangements could be used.

The first and second openings 28, 38 may be shaped and dimensioned to prevent lateral movement of the first and second plier members 20, 30 relative to each other. For example, the first and second openings 28, 38 may be substantially in the shape of a circle, which is shown in FIG. 1. Alternatively, the first opening 28 may be shaped and dimensioned to prevent lateral movement of the first plier member 20 relative to the pivot shaft 40 and the second opening 38 may be shaped and dimensioned to accommodate lateral movement of the second plier member 30 relative to the pivot shaft 40 so that a slip-joint lighted plier tool 12 may be assembled. For example, as shown in FIG. 2, the second opening 38 may be generally dumbbell-shaped, having part-circular end portions joined by a rectangular central portion having flat sides, and the first opening 28 may be generally circular in shape having a diameter substantially equal to the diameter of the part-circular end portions of the second opening 38. Alternatively, the first opening 28 may have a shape that is complementary to the cross-sectional shape of the pivot shaft 40. As one skilled in the art will appreciate, in a similar fashion the second opening 38 may be shaped and dimensioned to prevent lateral movement of the second plier member 30 relative to the pivot shaft 40, i.e., by being circular shaped or by being shaped complementary to the cross-sectional shape of the pivot shaft 40, and the first opening 28 may be shaped and dimensioned to accommodate lateral movement of the first plier member 20 relative to the pivot shaft 40, i.e., by being dumbbell shaped.

In conventional fashion, the pivot shaft 40 may be circular in cross-section to be complementarily received within the first and second openings 28, 38 as illustrated in FIG. 1. For use in a slip-joint plier tool 12, as shown in FIG. 2, the pivot shaft 40 is preferably non-circular in traverse cross-section and has a first end face 42 and an opposing second end face 44, and includes a first side face 46 and an opposing second side face 48 extending between the first end face 42 and the second end face 44. The first and second end faces 42, 44 preferably have a complementary curvature to the first opening 28 and the part-circular end portions of the second opening 38. The cross-sectional length of the pivot shaft between the first end face 42 and the second end face 44 is greater than the width of the rectangular central portion of the second opening 38 and less than the diameter of the first opening 28 and the part-circular end portions of the second opening 38. Further, the pivot shaft 40 has a cross-sectional width between the first side face 42 and the second side face 44 less than the width of the rectangular central portion of the second opening 38.

The lighted pliers 12 of the present invention are nearly identical in appearance with conventional pliers, or slip-joint pliers, which do not have a mechanism for illuminating at least a portion of the jaw portion 24 of the first plier member 20 and/or a portion of the jaw portion 34 of the second plier member 30. Accordingly, the slip-joint pliers 12 described may be used similarly to conventional slip-joint pliers in that the jaw portions 24, 34 of the first and second plier members 20, 30 is set at one of two adjustable opening angles by the engagement of the pivot shaft 40 in one of the partcircular end portions of the second opening 38.

Each handle portion 22, 32 of each plier member 20, 30 further has a distal end 21, 31, a proximal end 23, 23, and a length extending between the proximal and distal ends. At least a portion of the handle portion 22 of the first plier member 20 also has a longitudinal axis A. The handle portion 22 of the first plier member 20 also defines a bore 50 longitudinally extending along at least a portion of the length between the proximal and distal ends 21, 23, in which the bore has a bore front end 52 and an opposite bore back end 54. The bore back end 54 is located adjacent to the proximal end 21 of the handle portion 22 of the first plier member 20.

The handle portion 22 of the first plier member 20 includes a first handle body 60 having a proximal face 62 and an opposing distal face 64. The first handle body 60 acts as a housing for a light source 100 and power means of the present invention and, as such, the bore 50 of the handle portion 22 of the first plier member 20 extends the substantial length of the first handle body 60 from the proximal face 62 to the distal face 64 such that the bore front end 52 is disposed adjacent to the distal face 64 of the first handle body 60 and the bore back end 54 is located at the proximal face 62 of the first handle body 60.

Figure 6:
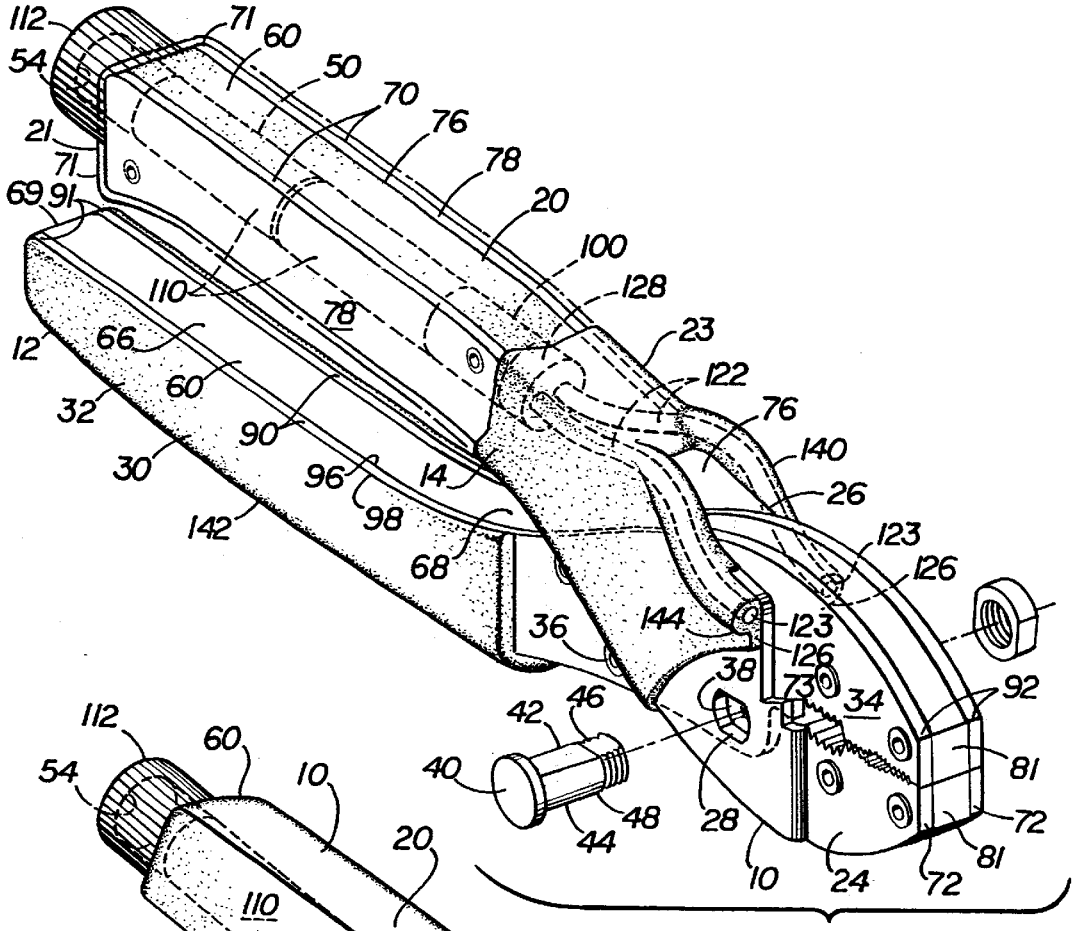
FIG. 6 is a perspective view of a third embodiment of a lighted tool of the present invention showing internal components in phantom.

The handle body 60 may be externally attached to or formed within the handle portion 22 of the first plier member 20. An example of an external attachment of the handle body 22 is shown in FIG. 1. The presently preferred embodiment is to internally form the handle body 60 within the handle portion 22. Specific designs of the preferred embodiment is shown in FIGS. 2–7. In the preferred embodiment, and as shown in FIGS. 2, 6, and 7, the first handle body 60 of the handle portion 22 of the first plier member is preferably connected to the handle portion 22 such that the handle body 60 is integrated into the handle portion 22 of the first plier member 20.

As one skilled in the art will appreciate, the handle portion 22 of the first plier member 20 may have any traverse cross-sectional shape that is suitable for connection to the handle body 60. For example, the handle portion 22 of the first plier member 20 may have a "I", "L", or "U" shape in traverse cross-section into which the handle body 60 is complementarily received. The handle body 60 may be fixedly attached to the first plier member 20, i.e., by welding, riveting or chemically bonding, or detachably secured to each other, i.e., by screwing or bolting. When the handle body 60 is attached to the handle portion 22 of the first plier member 20, the handle body 60 is considered to be a part of the handle portion 22 of the first plier member 20 as described herein and set forth in the claims.

However, referring to FIGS. 2, 6 and 7, it is preferred that the first plier member 20, in addition to the first handle body 60, be formed from two spaced-apart and opposing first plates 70 and a first jaw assembly 80. Each first plate 70 has a first plate front end 72 and an opposing first plate back end 71, and a first plate inner surface 73 and an opposing first plate exterior surface 74. The interior surfaces 73 of the opposing first plates 70 face each other. The first opening 28 of the first plier member 70 extends traversly through each of the first plates 70 so that the first openings 28 of the first plates 70 are substantially co-axial. To form the handle portion 22 of the first plier member 20, the first handle body 60 is interposed between and engaged thereto the first plate inner surfaces 73 of the opposed first plates 70 such that the proximal face 62 of the first handle body 60 is proximate the first plate back ends 71. The first jaw assembly 80 has a jaw front end 82 and a jaw back end 84 and at least a portion of the first jaw assembly 80 is interposed between and engaged thereto the first plate inner surfaces 73 so that the jaw front end 82 is proximate the first plate front ends 72 to form the jaw portion 24 of the first plier member 20. As one skilled in the art will appreciate with reference to FIGS. 6 and 7, the jaw back end 84 of the first jaw assembly 80, the distal face 64 of the first handle body 60, and the portions of the first plate inner surfaces 73 extending between the jaw back end 84 and the distal face 64 of the first handle body 60, which include the first openings 28, may define a slot 76 within the pivot section 26 of the first plier member 20.

Referring to FIGS. 2, 6, and 7, the second plier member 30 has an exterior surface 98 and may be formed from a single second plate 90, a plurality of stacked second plates 90, or, in a manner similar to that outlined above for the first plier member 20, may comprise two spaced-apart, opposing, second plates 90, a second handle body 66, and a second jaw assembly 86. As FIGS. 2, 6 and 7 shown, each second plate 90 has a second plate front end 92, an opposing second plate back end 91, a second plate interior surface 93, and an opposing second plate exterior surface 94. The interior surfaces 93 of the second plates 90 oppose each other. The second opening 38 of the second plier member 30 extends traversal through each of the opposing second plates 90 such that the second openings 38 of the second plates 90 are substantially co-axial with each other. To form the handle portion 32 of the second plier member 30, at least a portion of the second handle body 66 is interposed between and engaged thereto the inner surfaces 93 of the opposed second plates 90 adjacent the second plate back ends 91 so that the proximal face 68 of the second handle body 66 is adjacent the second plate back ends 91. Further, at least a portion of the second jaw assembly 86 is interposed between and engaged to the second plate inner surfaces 93 of the second plates 90 proximate the second plate front ends 92 to form the jaw portion 34 of the second plier member 30. A gap 96 that forms the pivot section 32 of the second plier member 30 is defined from the second jaw assembly 86, the distal face 69 of the second handle body 66, and the portions of the inner surfaces 93 of the second plates 90 extending between the second jaw assembly 86 and the distal face 69 of the second handle body 66 and which include the second openings 38.

The first and second plates 70, 90 and jaw assemblies 80, 86 are preferably formed of a metal or metal alloy, such as steel, stainless steel and the like. The first handle body 60 and the second handle body 66, if used, are preferably formed of a hardened plastic or other polymer known in the art, such as an blastomeric material.

As shown in FIGS. 6 and 7, the second plier member 30 may be inserted within the slot 76 of the first plier member 20 so that the exterior surfaces 98 of the second plier member 30 proximate the pivot section 36 of the second plier member 30 underlies the inner surfaces 73 of the first plates 70 forming the pivot section 26 of the first plier member 20. Alternatively, as shown in FIG. 2, the first plier member 20 may be inserted within the gap 96 of the second plier member 30 so that the portions of the second plate inner surfaces 93 that form the pivot section 36 of the second plier member 30 overlie the first plate exterior surfaces 74 of the first plates 70 proximate the pivot section 26 of the first plier member 20. In either configuration shown in FIGS. 2, 6 and 7, the first opening 28 and the second opening 38 in the respective first and second plier members 20, 30 are substantially co-axial.

Referring to FIG. 2, the first jaw assembly 80 may comprise at least one jaw plate 81. Similarly, the second jaw assembly 86 may include at least one jaw plate 81. Referring now to FIG. 7, if the second plier member 30 is formed from a single second plate 90 (not shown) or a plurality of stacked second plates 90, one or more jaw plates 81 may be connected to the exterior surface 98 of the second plier member 30 proximate the jaw portion 36. Thus, the jaw portion 36 of the second plier member 30 has a width that is complementary to the width of the jaw portion 26 of the first plier member 20. As one skilled in the art will appreciate, when the jaw plates 81 are attached to the respective first or second plates 70, 90, the grasping surface thus formed is preferably substantially contiguous.

Referring to FIGS. 2, 6 and 7, the lighted plier 12 preferably also includes at least one grip cover 140. Preferably, the grip cover 140 is disposed onto at least a portion of the exterior surface 78 of the first plier member 20, and more preferably, a second grip cover 141 is also disposed onto at least a portion of the exterior surface 98 of the second plier member 30. The grip cover 140, 141 may be formed from a soft plastic so that the grip cover 140, 141 may be malleable. Alternatively, the grip cover 140, 141 may be formed from a shaped hardened plastic or other polymer. One option with the use of a hardened plastic is to mold graphics (not shown), such as a trademark design, trademark name, or business name, into the grip cover(s) 140, 141 of the lighted plier 12.

Referring now to FIGS. 1, 3, 5 and 6, the illuminating means in the preferred embodiment comprises a light source 100 capable of producing a beam of light. The light source 100 is of a size to be complementarily received within the bore 50 of the handle portion 22 of the first plier member 20 so that the light source 100 is adjacent the bore front end 52. When illuminated, the beam of light produced by the light source 100 is in communication with at least a portion of the first plier member 20 and/or the second plier member 30, more particularly, with at least a portion of the jaw portion 22 of the first plier member 20 and/or a portion of the jaw portion 32 of the second plier member 32.

Figure 3:
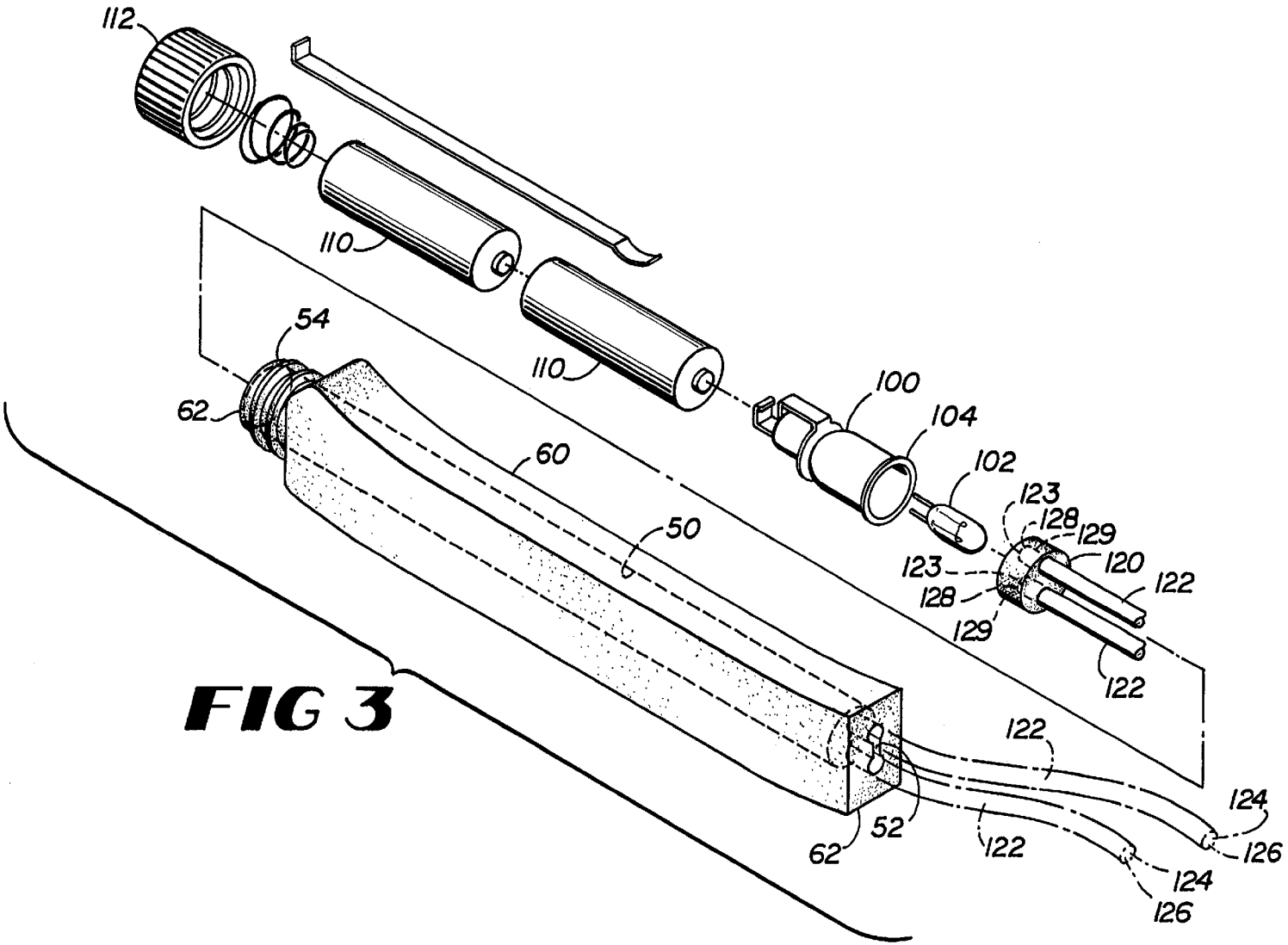
FIG. 3 is an exploded perspective view of a portion of a handle body of the handle portion of the first plier member of FIG. 2 showing the bore extending through the handle body and the light guide assembly and light source disposed within the bore.

Referring now to FIGS. 3 and 5, the preferred light source 100 comprises a light bulb 102 disposed near the bore front end 52 of the handle portion 22 and a reflective shield 104. The light bulb 102 is preferably recessed within the bore of the handle portion 50 adjacent its front end 52. The reflective shield 104 circumscribes at least a portion of the light bulb 102 so that when the power means energizes the light bulb 102 to produce light, the reflective shield 104 reflects a portion of the light to form the light beam, instead of light propagating in all directions. More specifically, the reflective shield 104 directs the light beam toward the bore front end 52. The reflective shield 104 is preferably parabolic in cross-section, which maximizes the efficacy of light produced by the light source 100. The parabolic reflective shield 104 also directs the maximum intensity of light in the light beam toward and through the bore front end 52 of the handle portion 22 of the first plier member 20.

As best shown in FIG. 1, the light source 100 of the light module 50 may additionally include a transparent covering 106 that shields the light bulb 102. The transparent covering 106, for example, encloses the reflective shield 104 and the light bulb 102 to prevent physical objects and moisture from contacting the light bulb 102.

Referring now to FIGS. 3 and 5, another aspect of the lighted plier tool 12 is a power means for energizing its light source 100. The power means can be any energy source known in the art that can be used to energize a light source, such as chemical energy or electrical energy. The power means comprises removable batteries 110 in the preferred embodiment that are disposed within the bore 50 of the first handle body intermediate the light source 100 and the bore back end 54. When the power means energizes the light source 100, the light source 100 produces the beam of light. The light source 100 and power means can, alternatively, be integral, such as a chemical compound used as both the light source with an inherent power means.

The power means can also comprise a switching means that selectively energizes and de-energizes the light bulb 102. Referring now to FIGS. 2, 3, 5 and 6, the switching means preferably comprises an on-off rotary switch 112 disposed at the proximal face 62 of the first handle body 60 in communication with the bore back end 54 of the first plier member 20. The light source 100 is movable between an on position, in which the switching means is positioned to energize the light bulb 102 using the power means, and an off position, in which the power means does not energize the light bulb 102.

Referring to FIG. 1, the beam of light travels through the bore front end 52, though the transparent covering 106, if one is provided. Accordingly, the light beam illuminates a desired portion of the first plier member 20 and/or the second plier member 30 and, preferably, also a portion of work space surrounding the jaw portions 26, 36 of the first and second plier members 20, 30, allowing the user to see the work area better.

Referring to FIGS. 2, 3, 5, 6, and 7, the lighted plier 12 of the present invention may also have a light guide assembly 120 that comprises at least one elongated optically conductive tube 122 having a first end 123 and an opposed second end 124. The first end 123 is secured proximate to the light source 100 within the bore 50 of the first plier member 20 so that the first end 123 is in communication with the light source 100. The second end 124 forms a light aperture 126. Thus, the beam of light produced by the energized light source 100 is in communication with the first end 123 of the tube 122 and travels from the first end 123 to the second end 124 of each optically conductive tube 122 to exit out of the light aperture 126.

The light guide assembly 120 may also comprise a guide head 128. The guide head 128 is of a size to be complementarily received within the bore 50 of the handle portion 22 of the first plier member 20 and is disposed within the bore 50 of the handle portion 22 of the first plier member 20 next to the bore front end 52 and intermediate the bore front end 52 and the light source 100. The guide head 128 has at least one channel 129 extending therethrough. Each channel 129 of the guide head 129 is sized for receipt and connection of the first end 123 of one optically conductive tube 122. Thus, the guide head 128 orients the first end 123 of each optically conductive tube 122 and secures the relative position of the first end 123 of each tube to the light source 100.

As shown in FIGS. 2 and 5, in one preferred embodiment of the light plier tool 12, two optically conductive tubes 122 are shown. As one skilled in the art will appreciate however, the lighted plier tool 12 may include the use of one, two, or three or more optically conductive tubes 122 as required. In this example, the second end 124 of one optically conductive tube 122 is connected to the first plier member 20 near the jaw back end 84 of the first jaw assembly 80 of the first plier member 20. The second end 124 of one other optically conductive tube 122 is connected to the first plier member 20 near the jaw front end 82 of the first jaw assembly 80 of the first plier member 20.

To aid in securing the second end 124 of the optically conductive tube 122 and to protect the integrity of the tube 122 from possible damage from contact with physical objects in the environment, spacer plates 130 may be provided. The spacer plates 130 are secured to the first plate inner surface 73 and in conjunction with the jaw plates 81 of the first jaw assembly 80 of the first plier member 20 define at least one passageway 132. The spacer plates 130 preferably extend from the distal face 64 of the first handle body 60. Each optically conductive tube 122 in the example extends from the guide head 128, where it is in communication with the light source 100, through a passageway 132 until reaching the end of the passageway 132 where the second end 124 of the tube 122 is secured. Thus, when the light source 100 is energized, the beam of light is communicated to the first end 123 of the optically conductive tube 122 to the second end 124 to be subsequently projected from the aperture 126 which is proximate the jaw portion 24 of the first plier member 20. Accordingly, the light beam projected from the aperture 126 illuminates the desired portions of the lighted tool 12 and surrounding environment which allows the user to see the work area and/or work piece better.

Referring now to FIGS. 6 and 7, alternative embodiments of the lighted plier 12 are shown. In these embodiments, the second end 124 of the optically conductive tube 122 is secured to the exterior surface 78 of the first plier member 20 proximate the pivot section 26 of the first plier member 20 so that the aperture 126 of the second end 124 of the tube 122 is oriented toward the jaw portions 24, 34 of the first and second plier members 20, 30. Each optically conductive tube 122 extends from the guide head 128, where it is in communication with the light source 100, along a portion of the exterior surface 74 of one of the first plates 70 of the first plier member 20. Thus, the light beam is communicated to the second end 124 of the tube 122 and is projected from the aperture 126 which illuminates the desired portions of the lighted tool 12 and surrounding environment which, in turn, allows the user to see the work area and/or work piece better.

The second end 124 of the tube 122 may be mechanically or chemically secured to the exterior surface 78 of the first plier member 20 by any means known to one skilled in the art. For example, the second end 124 of the tube 122 may be secured by mechanically screwing, riveting, or bolting a loop (not shown) that surrounds at least a portion of the tube 122 near the second end 124 to the exterior surface 74 of the first plates 70 of the first plier member 20. Alternatively, for example, the second end 124 of the tube 122 may be chemically adhered to the exterior surface 74 of the first plates 70 of the first plier member 20 by use of an appropriate chemical adhesive.

However, the preferred means of securing the second end 124 of each optically conductive tube 122 is to secure a grip cover 140 to the first plier member 20 that encases at least the second end 124 of each tube 122. In this example, the grip cover 140 encases at least a portion of the tube 122 that extends on the exterior surface 78 of the first plier member 20 and a portion of the exterior surface of the handle portion 22 and pivot section 32 of the first plier member 20 so that the second end 124 of the tube 122 is non-movably secured relative to the first plier member 20. To prevent damage to the second end 124 of a tube 122 that is secured to the first plier member 20 by a grip cover 140, it is preferred that the grip cover 140 has a translucent portion or lens 144 that covers the second end 124 of the tube 122.

As one skilled in the art will appreciate, the dimensions of the first and second plier members 20, 30, the first handle body 60, and the light source 100, and the number of optically conductive tubes 122, if utilized, can be changed, depending on factors such as the anticipated use of the lighted plier tool 12, manufacturing considerations, and cost.

Although the present invention has been described with reference to specific details of certain embodiments thereof, it is not intended that such details should be regarded as limitations upon the scope of the invention except as and to the extent that they are included in the accompanying claims.

What is claimed is:

1. A lighted plier, comprising:

a. a first plier member, a second plier member, each plier member having a handle portion, a jaw portion, and a pivot section intermediate the handle portion and the jaw portion, the handle portion of the first plier member having a distal end, a proximal end, and a length extending between the proximal and distal ends, the handle portion of the first plier member defining a bore longitudinally extending along at least a portion of the length, the bore having a bore front end near the pivot section of the first plier member and an opposed bore back end adjacent the proximal end of the handle portion of the first plier member, the second plier member pivotally mounted relative to the pivot section of the first plier member at the pivot section of the second plier member to be pivotally moveable relative to the first plier member;

b. a light source capable of producing a beam of light, the light source disposed within the bore of the handle portion adjacent the bore front end, wherein the beam of light produced by the light source is in communication with at least a portion of the first and second plier members;

c. at least one elongated optically conductive tube having a first end proximal to and in communication with the light source and an opposed second end which forms a light aperture, wherein the beam of light produced by the light source is in communication with the first end of the tube and travels from the first end to the second end thereof to exit out of the light aperture;

d. a guide head disposed within the bore of the handle portion of the first plier member between the bore front end of the bore and the light source, the guide head having at least one channel extending therethrough, wherein the first end of the tube is connected to the channel; and e. power means for energizing the light source.

2. The lighted plier of claim 1, wherein the light source comprises:

a. a light bulb disposed adjacent the bore front end; and b. a reflective shield circumscribing at least a portion of the light bulb so that, when the light bulb produces light, the reflective shield reflects a portion of the light to form a light beam that is directed toward the bore front end.

3. The lighted plier of claim 1, wherein the power means is disposed within the bore of the handle portion of the first plier member intermediate the light source and the bore back end of the bore.

4. The lighted plier of claim 1, further comprising a pivot shaft, wherein the first plier member has a first opening extending through the pivot section of the first plier member, wherein the second plier member has a second opening extending through the pivot section of the second plier member, and wherein the pivot shaft extends through the first and the second openings for pivotally interconnecting the first and second plier members.

5. The lighted plier of claim 4, wherein the first opening is shaped and dimensioned to prevent lateral movement of the first plier member relative to the pivot shaft.

6. The lighted plier of claim 5, wherein the second opening is shaped and dimensioned to accommodate lateral movement of the second plier member relative to the pivot shaft.

7. The lighted plier of claim 1, wherein the first plier member has an exterior surface, and wherein the second end of the tube is secured to the exterior surface of the first plier member proximate the pivot section of the first plier member.

8. The lighted plier of claim 7, wherein the optically conductive tube extends along a portion of the exterior surface of the first plier member, the lighted plier further comprising a grip cover encasing a portion of the tube extending on the exterior surface of the first plier member and a portion of the exterior surface of the handle portion and the pivot section of the first plier member so that the second end of the tube is secured relative to the first plier member.

9. The lighted plier of claim 1, wherein the jaw portion of the first plier member has a front end and an opposed back end proximate the pivot section of the first plier member, wherein the second end of the tube is connected to the first plier member near the back end of the jaw portion.

10. The lighted plier of claim 1, wherein the jaw portion of the first plier member has a front end and an opposed back end proximate the pivot section of the first plier member, and wherein the second end of the tube is connected to the first plier member near the front end of the jaw portion of the first plier member.

11. The lighted plier of claim 1, wherein the light plier includes a first elongated optically conductive tube and a second elongated optically conductive tube, wherein the jaw portion of the first plier member has a front end and an opposed back end proximate the pivot section of the first plier member, wherein the second end of the first tube is connected to the first plier member near the front end of the jaw portion of the first plier member, and wherein the second end of the second tube is connected to the first plier member near the back end of the first jaw portion of the first plier member.

12. A lighted plier, comprising:

a. a first plier member and a second plier member, each plier member having a handle portion, a pivot section, and a jaw portion, the pivot section positioned intermediate the handle portion and the jaw portion for each plier member, each plier member further having respective first and second openings formed through the pivot sections of the respective first and second plier members, wherein the handle portion of the first plier member has a distal end, a proximal end and a length extending between the proximal and distal ends, the first handle portion defining a bore longitudinally extending along at least a portion of the length, the bore having a bore front end near the pivot section of the first plier section and an opposite bore back end adjacent the proximal end of the first handle portion;

b. a pivot shaft extending through the first and second openings of the respective the first and the second plier member for pivotally interconnecting the first and the second plier members so that the plier members are moveable between a closed position, in which a portion of the jaw portions of the first and second plier members contact each other, and an opened position, in which the jaw portions are spaced apart;

c. a light source capable of producing a beam of light, the light source disposed within the bore of the handle portion of the first plier member adjacent the bore front end;

d. a light guide assembly having at least one elongated optically conductive tube having a first light end and a second light end forming a light aperture, the first light end of each tube is secured proximate to the light source within the bore so that the first light end is in communication with the light source, the second light end is connected to the first plier member;

e. a guide head disposed within the bore of the handle portion next to the bore front end and intermediate the bore front end and the light source, wherein the first light end of the optically conductive tube is secured to the guide head; and f. power means for energizing the light source, wherein the beam of light produced by the light source communicates with the first light end of the tube of the light guide assembly and travels from the first light end to the second light end of each optically conductive tube to exit out of the light aperture.

13. The lighted plier of claim 12, wherein the guide head includes at least one channel extending therethrough, each channel sized to complementarily the first light end of one optically conductive tube.

14. The lighted plier of claim 13, wherein the first plier member comprises two spaced-apart, opposing, first plates, a first handle body, and a first jaw assembly, each first plate having a first plate front end, an opposing first plate back end, a first plate inner surface, and an opposing first plate exterior surface, the first opening of the first plier member extending through each of the opposing first plates forming the first plier member such that the first openings of the first plates are substantially co-axial, wherein the first handle body has a proximal face and a distal face, at least a portion of the first handle body interposed between and engaged thereto the first plate inner surfaces of the opposed first plates so that the proximal face of the first handle body is adjacent the first plate back ends, wherein the first jaw assembly has a jaw front end and a jaw back end, at least a portion of the first jaw assembly interposed between and engaged thereto the first plate inner surfaces so that the jaw front end is proximate the first plate front ends to form the jaw portion of the first plier member, wherein the jaw back end, the distal end of the first handle body, and the portions of the first plate inner surfaces extending between the jaw back end and the distal end of the first handle body and having the first openings define a slot that forms the pivot section of the first plier member.

15. The lighted plier of claim 14, wherein the bore of the handle portion of the first plier member extends through the first handle body of the first plier member from the proximal face to the distal face of the first handle body so that the bore front end is proximate the distal face of the first handle body and the bore back end is proximate the proximal face of the first handle body.

16. The lighted plier of claim 14, wherein the second plier member has an exterior surface, and wherein the portions of the first plate inner surfaces of the first plates forming the pivot section of the first plier member face the exterior surface of the first plier member proximate the pivot section of the second plier member, and wherein the first opening of the first plier member and the second opening of the second plier member are co-axial to each other.

17. The lighted plier of claim 14, wherein the second plier member comprises two spaced-apart, opposing, second plates, a second handle body, and a second jaw assembly, each second plate having a second plate front end, an opposing second plate back end, a second plate inner surface, and an opposing second plate exterior surface, the second opening of the second plier member extending through each of the opposing second plates forming the second plier member such that the second openings of the second plates are substantially co-axial, wherein the second handle body has a proximal face and a distal face, at least a portion of the second handle body interposed between and engaged thereto the second plate inner surfaces of the opposed second plates so that the proximal face of the second handle body is adjacent the second plate back ends, wherein at least a portion of the second jaw assembly is interposed between and engaged thereto the second plate inner surfaces of the opposed second plates proximate the second plate front ends of the second plates to form the jaw portion of the second plier member, wherein the second jaw assembly, the distal face of the second handle body, and the portions of the inner surfaces of the second plates extending between the second jaw assembly and the distal face of the second handle body and having the second openings define an gap that forms the pivot section of the second plier member.

18. The lighted plier of claim 17, wherein the portions of the second plate inner surfaces forming the pivot section of the second plier member face the first plate exterior surfaces of the first plates proximate the pivot section of the first plier member.

19. The lighted plier of claim 12, wherein the light source comprises:

a. a light bulb disposed adjacent the first light end of the optically conductive tube of the light guide assembly; and b. a reflective shield circumscribing at least a portion of the light bulb so that, when the light bulb produces light, the reflective shield reflects a portion of the light to form a light beam that is directed toward the first light end head of the light bulb assembly.

20. The lighted plier of claim 12, wherein the power means is disposed within the bore of the handle portion of the first plier member intermediate the light source and the back end of the bore.

21. The lighted plier of claim 14, wherein the first jaw assembly comprises at least one jaw plate.

22. The lighted plier of claim 17, wherein the second jaw assembly comprises at least one jaw plate.

23. The lighted plier of claim 12, wherein the first opening is shaped and dimensioned to prevent lateral movement of the first plier member relative to the pivot shaft.

24. The lighted plier of claim 23, wherein the second opening is shaped and dimensioned to accommodate lateral movement of the second plier member relative to the pivot shaft.

25. The lighted plier of claim 16, wherein the second light end of the optically conductive tube is secured to the first plate exterior surface of the first plate of the first plier member proximate the pivot section of the first plier member.

26. The lighted plier of claim 25, wherein the optically conductive tube extends along a portion of the exterior surface of the first plier member, further comprising a grip cover encasing at least a portion of the tube extending on the exterior surface of the first plier member and a portion of the exterior surface of the handle portion and the pivot section of the first plier member so that the second light end of the optically conductive tube is secured relative to the first plier member.

27. The lighted plier of claim 14, wherein the second light end of the optically conductive tube is connected to the first plier member near the jaw back end of the jaw assembly of the first plier member.

28. The lighted plier of claim 14, wherein the second light end of the optically conductive tube is connected to the first plier member near the jaw front end of the first jaw portion.

29. The lighted plier of claim 14, wherein the light plier includes a first elongated optically conductive tube and a second elongated optically conductive tube, wherein the second light end of the first optically conductive tube is connected to the first plier member near the jaw front end of the first jaw portion, and wherein the second light end of the second optically conductive tube is connected to the first plier member near the jaw back end of the first jaw portion.

30. A method of illuminating a portion of a work piece that is proximate to a portion of a lighted plier, the lighted plier including a first plier member and a second plier member, each plier member having a handle portion, a jaw portion, and a pivot section intermediate the handle portion and the jaw portion, the handle portion of the first plier member defining a bore, the bore having a bore front end near the pivot section of the first plier member, the second plier member pivotally mounted relative to the pivot section of the first plier member at the pivot section of the second plier member to be pivotally moveable relative to the first plier member, the first plier member having a first opening extending through the pivot section of the first plier member, the first opening shaped and dimensioned to prevent lateral movement of the first plier member relative to the pivot shaft and the second plier member having a second opening extending through the pivot section of the second plier member, the lighted plier including a pivot shaft extending through the first and the second openings for pivotally interconnecting the first and second plier members, the lighted plier further including a light source disposed therein the bore of the handle portion of the first plier member, comprising energizing the light source so as to produce a beam of light that is in communication with at least one portion of the jaw portion of the first plier member and at least one portion of the work piece.

31. A lighted plier, comprising:

a. a first plier member, a second plier member, each plier member having a handle portion, a jaw portion, and a pivot section intermediate the handle portion and the jaw portion, the handle portion of the first plier member having a proximal end and defining a bore, the bore having a bore front end near the pivot section of the first plier member and an opposed bore back end adjacent the proximal end of the handle portion of the first plier member, the second plier member pivotally mounted relative to the pivot section of the first plier member at the pivot section of the second plier member to be pivotally moveable relative to the first plier member;

b. a light source capable of producing a beam of light, the light source disposed within the bore of the handle portion adjacent the bore front end;

c. a pivot shaft, wherein the first plier member has a first opening extending through the pivot section of the first plier member, the first opening shaped and dimensioned to prevent lateral movement of the first plier member relative to the pivot shaft; wherein the second plier member has a second opening extending through the pivot section of the second plier member, wherein the pivot shaft extends through the first and the second openings for pivotally interconnecting the first and second plier members; and d. power means for energizing the light source.

32. The lighted plier of claim 31, wherein the beam of light produced by the light source is in communication with at least a portion of the first and second plier members.

33. The lighted plier of claim 31, further comprising at least one elongated optically conductive tube having a first end proximal to and in communication with the light source and an opposed second end which forms a light aperture, wherein the beam of light produced by the light source is in communication with the first end of the tube and travels from the first end to the second end thereof to exit out of the light aperture.

34. The lighted plier of claim 33, further comprising a guide head disposed within the bore of the handle portion of the first plier member between the bore front end of the bore and the light source, the guide head having at least one channel extending therethrough, wherein the first end of the tube is connected to the channel.

35. The lighted plier of claim 31, wherein the second opening is shaped and dimensioned to accommodate lateral movement of the second plier member relative to the pivot shaft.

36. A lighted plier, comprising:

a. a first plier member, a second plier member, each plier member having a handle portion, a jaw portion, and a pivot section intermediate the handle portion and the jaw portion, the handle portion of the first plier member having a proximal end and defining a bore, the bore having a bore front end near the pivot section of the first plier member and an opposed bore back end adjacent the proximal end of the handle portion of the first plier member, the second plier member pivotally mounted relative to the pivot section of the first plier member at the pivot section of the second plier member to be pivotally moveable relative to the first plier member;

b. a light source capable of producing a beam of light, the light source disposed within the bore of the handle portion adjacent the bore front end;

c. at least one elongated optically conductive tube having a first end proximal to and in communication with the light source and an opposed second end which forms a light aperture, wherein the beam of light produced by the light source is in communication with the first end of the tube and travels from the first end to the second end thereof to exit out of the light aperture; and d. power means for energizing the light source, wherein the jaw portion of the first plier member has a front end and an opposed back end proximate the pivot section of the first plier member, and wherein the second end of the tube is connected to the first plier member near the front end of the jaw portion of the first plier member.

37. The lighted plier of claim 36, wherein the beam of light produced by the light source is in communication with at least a portion of the first and second plier members.

38. A lighted plier, comprising:

a. a first plier member, a second plier member, each plier member having a handle portion, a jaw portion, and a pivot section intermediate the handle portion and the jaw portion, the handle portion of the first plier member having a proximal end and defining a bore, the bore having a bore front end near the pivot section of the first plier member and an opposed bore back end adjacent the proximal end of the handle portion of the first plier member, the second plier member pivotally mounted relative to the pivot section of the first plier member at the pivot section of the second plier member to be pivotally moveable relative to the first plier member;

b. a light source capable of producing abeam of light, the light source disposed within the bore of the handle portion adjacent the bore front end;

c. a first elongated optically conductive tube and a second elongated optically conductive tube, each elongated optically conductive tube having a first end proximal to and in communication with the light source and an opposed second end which forms a light aperture, wherein the beam of light produced by the light source is in communication with the first end of the tube and travels from the first end to the second end thereof to exit out of the light aperture; and d. power means for energizing the light source, wherein the jaw portion of the first plier member has a front end and an opposed back end proximate the pivot section of the first plier member, wherein the second end of the first optically conductive tube is connected to the first plier member near the front end of the jaw portion of the first plier member, and wherein the second end of the second optically conductive tube is connected to the first plier member near the back end of the first jaw portion of the first plier member.

39. The lighted plier of claim 38, wherein the beam of light produced by the light source is in communication with at least a portion of the first and second plier members.

40. An lighted plier, comprising:

a. a first plier member and a second plier member, each plier member having a handle portion, a pivot section, and a jaw portion, the pivot section positioned intermediate the handle portion and the jaw portion for each plier member, each plier member further having respective first and second openings formed through the pivot sections of the respective first and second plier members, wherein the first opening is shaped and dimensioned to prevent lateral movement of the first plier member relative to the pivot shaft and the second opening is shaped and dimensioned to accommodate lateral movement of the second plier member relative to the pivot shaft, and wherein the handle portion of the first plier member has a proximal end and defining a bore, the bore having a bore front end near the pivot section of the first plier section and an opposite bore back end adjacent the proximal end of the first handle portion;

b. a pivot shaft extending through the first and second openings of the respective the first and the second plier member for pivotally interconnecting the first and the second plier members so that the plier members are moveable between a closed position, in which a portion of the jaw portions of the first and second plier members contact each other, and an opened position, in which the jaw portions are spaced apart;

c. a light source capable of producing a beam of light, the light source disposed within the bore of the handle portion of the first plier member adjacent the bore front end;

d. a light guide assembly having at least one elongated optically conductive tube having a first light end and a second light end forming a light aperture, the first light end of each tube is secured proximate to the light source within the bore so that the first light end is in communication with the light source, the second light end is connected to the first plier member; and e. power means for energizing the light source, wherein the beam of light produced by the light source communicates with the first light end of the tube of the light guide assembly and travels from the first light end to the second light end of each optically conductive tube to exit out of the light aperture.

41. The lighted plier of claim 40, further comprising a guide head disposed within the bore of the handle portion next to the bore front end and intermediate the bore front end and the light source, wherein the first light end of the optically conductive tube is secured to the guide head.

42. The lighted plier of claim 41, wherein the guide head includes at least one channel extending therethrough, each channel sized to complementarily the first light end of one optically conductive tube.

43. The lighted plier of claim 40, wherein the power means is disposed within the bore of the handle portion of the first plier member intermediate the light source and the back end of the bore.

44. The lighted plier of claim 40, wherein the jaw portion of the first plier member has a front end and an opposed back end proximate the pivot section of the first plier member, and wherein the second light end of the optically conductive tube is connected to the first plier member near the jaw back end of the jaw portion of the first plier member.

45. The lighted plier of claim 40, wherein the jaw portion of the first plier member has a front end and an opposed back end proximate the pivot section of the first plier member, wherein the second light end of the optically conductive tube is connected to the first plier member near the jaw front end of the jaw portion of the first plier member.

46. The lighted plier of claim 40, wherein the light plier includes a first elongated optically conductive tube and a second elongated optically conductive tube, wherein the jaw portion of the first plier member has a front end and an opposed back end proximate the pivot section of the first plier member, wherein the second end of the first tube is connected to the first plier member near the front end of the jaw portion of the first plier member, and wherein the second end of the second tube is connected to the first plier member near the back end of the first jaw portion of the first plier member.

* * * * *